US005768861A

United States Patent [19]

Slenders

[11] Patent Number: 5,768,861

[45] Date of Patent: Jun. 23, 1998

[54] BAG FORMING, FILLING, AND SEALING MACHINE

[75] Inventor: Peter Slenders, Maarheeze, Netherlands

[73] Assignee: Robert Bosch GmbH, Stuttgart, Germany

[21] Appl. No.: 860,476

[22] PCT Filed: Jul. 9, 1996

[86] PCT No.: PCT/DE96/01233

§ 371 Date: Jun. 24, 1997

§ 102(e) Date: Jun. 24, 1997

[87] PCT Pub. No.: WO97/15498

PCT Pub. Date: May 1, 1997

[30] Foreign Application Priority Data

Oct. 26, 1995 [DE] Germany ..... 195 39 888.2

[51] Int. Cl.[6] ..... B65B 9/20; B65B 9/22

[52] U.S. Cl. ..... 53/551; 53/552

[58] Field of Search ..... 53/412, 451, 133.4, 53/551, 552; 493/213, 302, 308, 297

[56] References Cited

U.S. PATENT DOCUMENTS

| | | | |
|---|---|---|---|
| 4,697,403 | 10/1987 | Simpson et al. | 53/551 |
| 5,014,497 | 5/1991 | McMahon | 53/551 X |
| 5,046,300 | 9/1991 | Custer et al. | 53/551 X |
| 5,127,208 | 7/1992 | Custer et al. | 53/551 X |
| 5,400,568 | 3/1995 | Kanemitsu et al. | 53/412 |
| 5,425,216 | 6/1995 | Ausnit | 53/451 X |
| 5,505,040 | 4/1996 | Janssen et al. | 53/451 |
| 5,551,208 | 9/1996 | Van Erden | 53/451 X |
| 5,685,132 | 11/1997 | Romijn et al. | 53/551 |

OTHER PUBLICATIONS

Patent Abstracts of Japan. Band 13, Nr 573, M–909, Abstract of JP, A, 1–240408 (Dainippon Printing Co.) Mar. 8, 1988.

*Primary Examiner*—Horace M. Culver
*Attorney, Agent, or Firm*—Edwin E. Greigg; Ronald E. Greigg

[57] ABSTRACT

A bag forming, filling, and sealing machine (10) for producing bag packages (1) has a tube forming device (7) comprised of a forming shoulder (18) and a forming tube (19) connected to it. In order to permit a bag forming, filling, and sealing machine (10) of this kind to produce bag packages (1) out of a single sheet of packaging material (15), with two longitudinal seams (11, 12) and two lateral seams (13, 14), the forming tube (19) has two sections (24, 25) connected to each other. The one section (24) connected to the forming tube (19) is inclined in relation to the incoming sheet of packaging material (15) by an angle (α). In addition, an element (28) for forming the one longitudinal seam (11) is connected to the forming tube (19). The tube forming device (17) cooperates with two diametrically opposed longitudinal seam sealers (33, 34) and a lateral seam sealer (41).

19 Claims, 3 Drawing Sheets

BAG FORMING, FILLING, AND SEALING MACHINE

PRIOR ART

The invention relates to a bag forming, filling, and sealing machine. Machines of this kind for producing so-called 4-edge bag packages have already been disclosed. These bag packages have two sealed longitudinal seams and two sealed lateral seams. For this purpose, the known bag forming, filling, and sealing machines work with two heat-sealable devices which are superposed one covering the other, whereupon sealing devices disposed laterally to the sheets of packaging material form the two longitudinal seals. The tube thus formed is then supplied to a lateral sealing device for the production of the two lateral seams. Furthermore, vertical bag forming, filling, and sealing machines have been disclosed which have a tube forming device comprised of a forming shoulder and a forming tube. However, the production of the above-mentioned 4-edge bag packages with bag forming, filling, and sealing machines of this kind by means of a single sheet of packaging material has not been possible up to this point.

ADVANTAGES OF THE INVENTION

The bag forming, filling, and sealing machine, has the advantage over the prior art that 4-edge bag packages with two longitudinal seams and two lateral seams can be produced from a single sheet of packaging material using bag forming, filling, and sealing machines which have a forming shoulder and a forming tube. This is achieved according to the invention by means of a one-piece, angled forming tube and a wedge-shaped element. With these two elements, it is possible to form the second longitudinal seam from one part of the tube wall, without tensions being produced in the tube which otherwise would harm the form or functionality of the bag packages.

Other advantages and advantageous improvements of the bag forming, filling, and sealing machine according to the invention ensue from the description set forth hereinafter. An improved formation of the longitudinal seal and a more precise supply of the longitudinal seal to the subsequent longitudinal seam sealer can be achieved by means of two guides, which are disposed on both sides of the shoulder element. The width of the longitudinal seam can be adjusted in a simple manner by means of a cutting device connected to the longitudinal seam sealer.

BRIEF DESCRIPTION OF THE DRAWINGS

An exemplary embodiment of the invention is shown in the drawing and explained in detail in the description below.

DESCRIPTION OF THE EXEMPLARY EMBODIMENT

Figure 1:
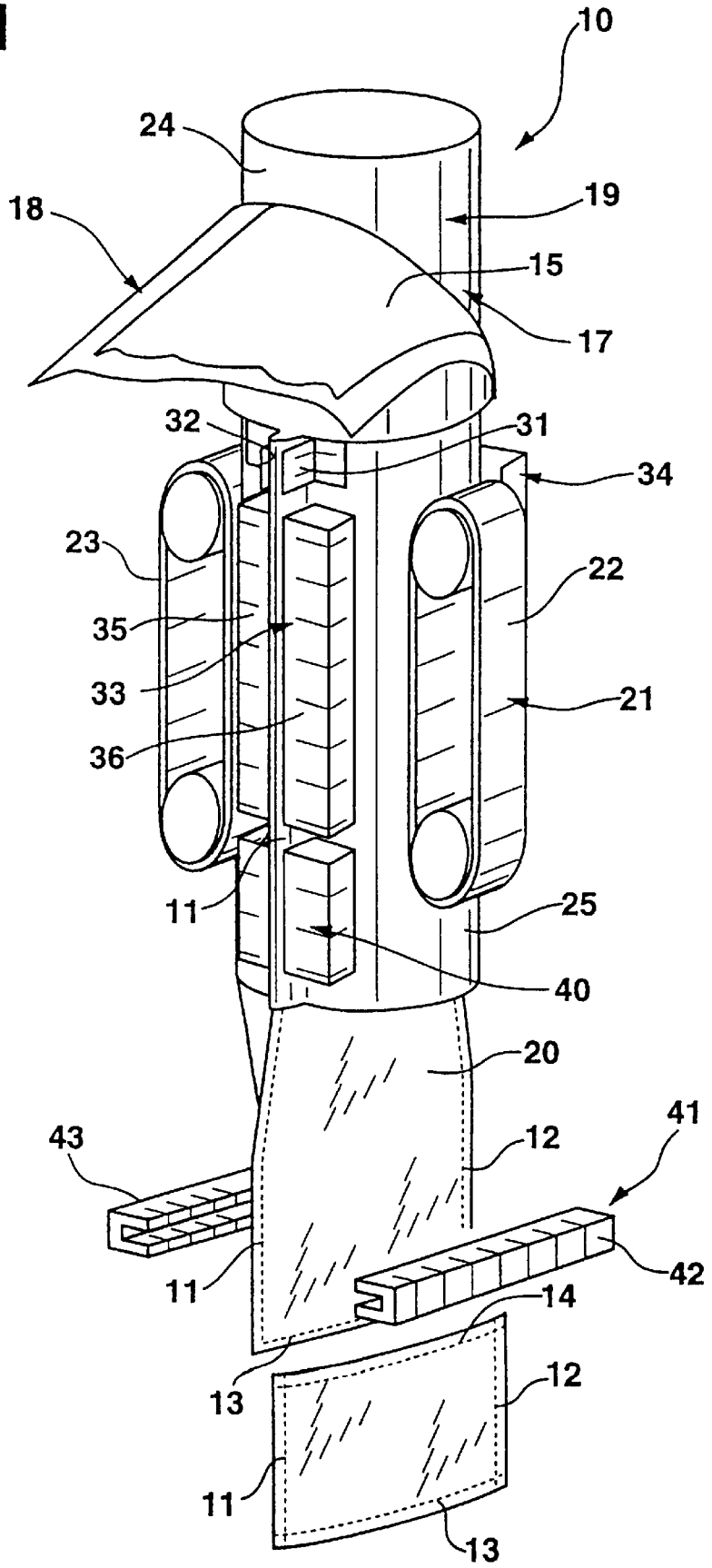
FIG. 1 is a perspective view of a bag forming, filling, and sealing machine.
Figure 2:
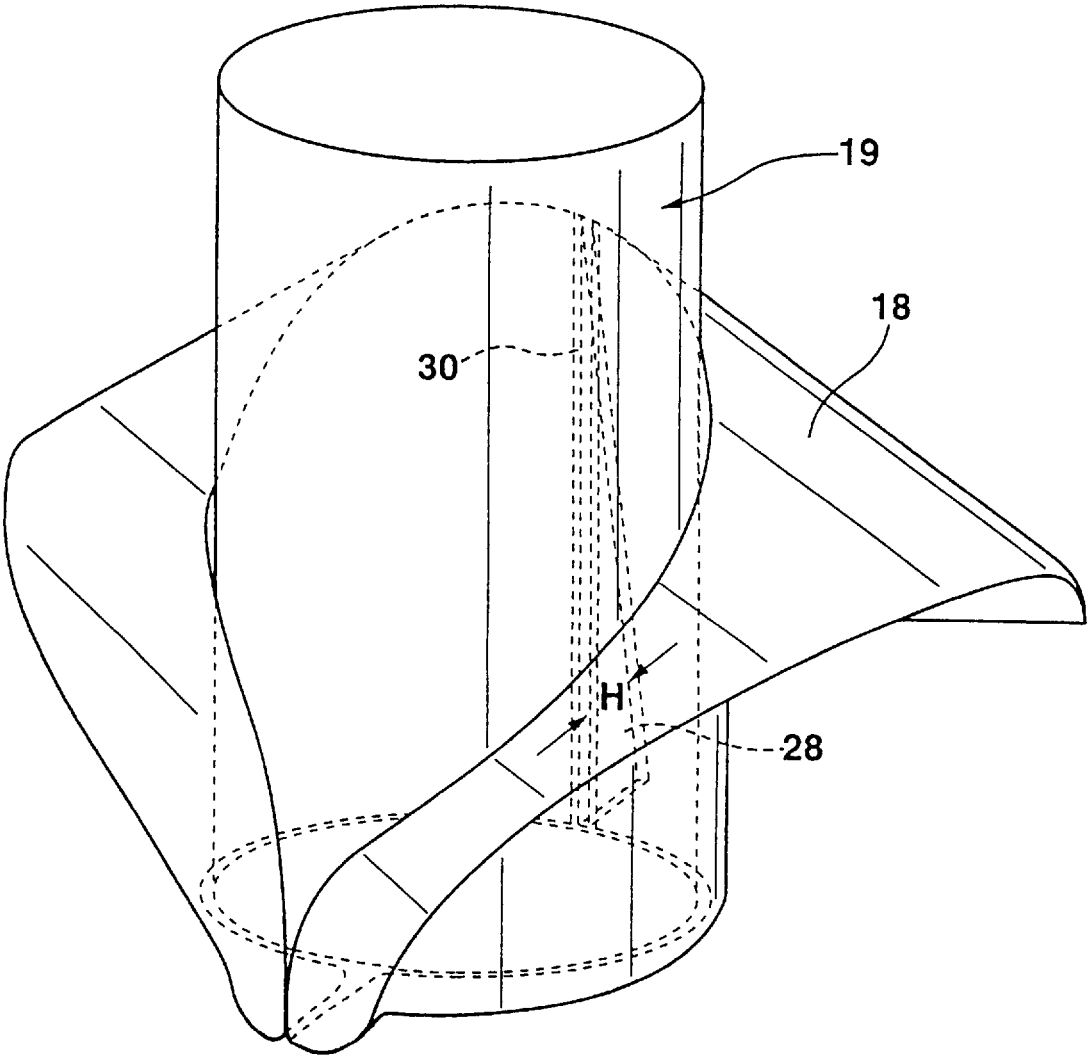
FIG. 2 is a perspective view of a part of the machine according to FIG. 1.

The bag forming, filling, and sealing machine 10 shown in FIG. 1 is used for the production of bag packages 1 with two longitudinal seams 11, 12 and two lateral seams 13, 14 out of one heat-sealable sheet of packaging material 15. For this purpose, the bag forming, filling, and sealing machine 10 has a tube forming device 17, which is comprised of a forming shoulder 18 and a forming tube 19 connected to it. The endless sheet of packaging material 15 is formed into a tube 20 by means of the tube forming device 17. On the forming tube 19, a device 21 is disposed that has two preferably vacuum supported conveyor belts 22, 23 for feeding the tube 20 downwardly.

The cylindrical forming tube 19 has two sections 24, 25 with equal outer diameters, which are connected flush to each other in order to avoid producing shoulders or edges. The symmetry axis 26 of the first section 24, which is connected to the forming shoulder 18, is inclined in relation to the symmetry axis 27 of the second section 25 by an angle $\alpha$, wherein the angle $\alpha$ points in the direction of the incoming sheet of packaging material 15. On the first section 24 of the forming tube 19, on the side of the incoming sheet of packaging material 15, a wedge-like, plate-shaped element 28, which protrudes perpendicularly from the first section 24 and continuously tapers in its width H toward the second section 25. The element 28 covers the entire region in which the forming shoulder 18 is connected to the forming tube 19, where in the region of the element 28, the forming shoulder 18 has a slot 30 which is at least slightly wider than the element 28 so that a part of the tube wall can be guided through between the side faces of the element 28 and the slot 30. The element 28 continues in the second section 25 in a rectangular shoulder element 29 with a constant width, wherein its height corresponds to the maximal width B(max) of the element 28.

On both sides of the shoulder element 29, two guide angles 31 for the tube 20 are disposed, whose guide faces 32 extend parallel to and spaced slightly apart from the shoulder element 29. Advantageously, the guide angles 31 are embodied extending even into the region of the element 28. Two diametrically opposed pairs of sealing clamps 33, 34 for producing the longitudinal seams 11, 12 are disposed at the level of the conveyor belts 22, 23. The one pair of sealing clamps 33 is aligned flush with the element 28 or with the shoulder element 29.

Figure 3:
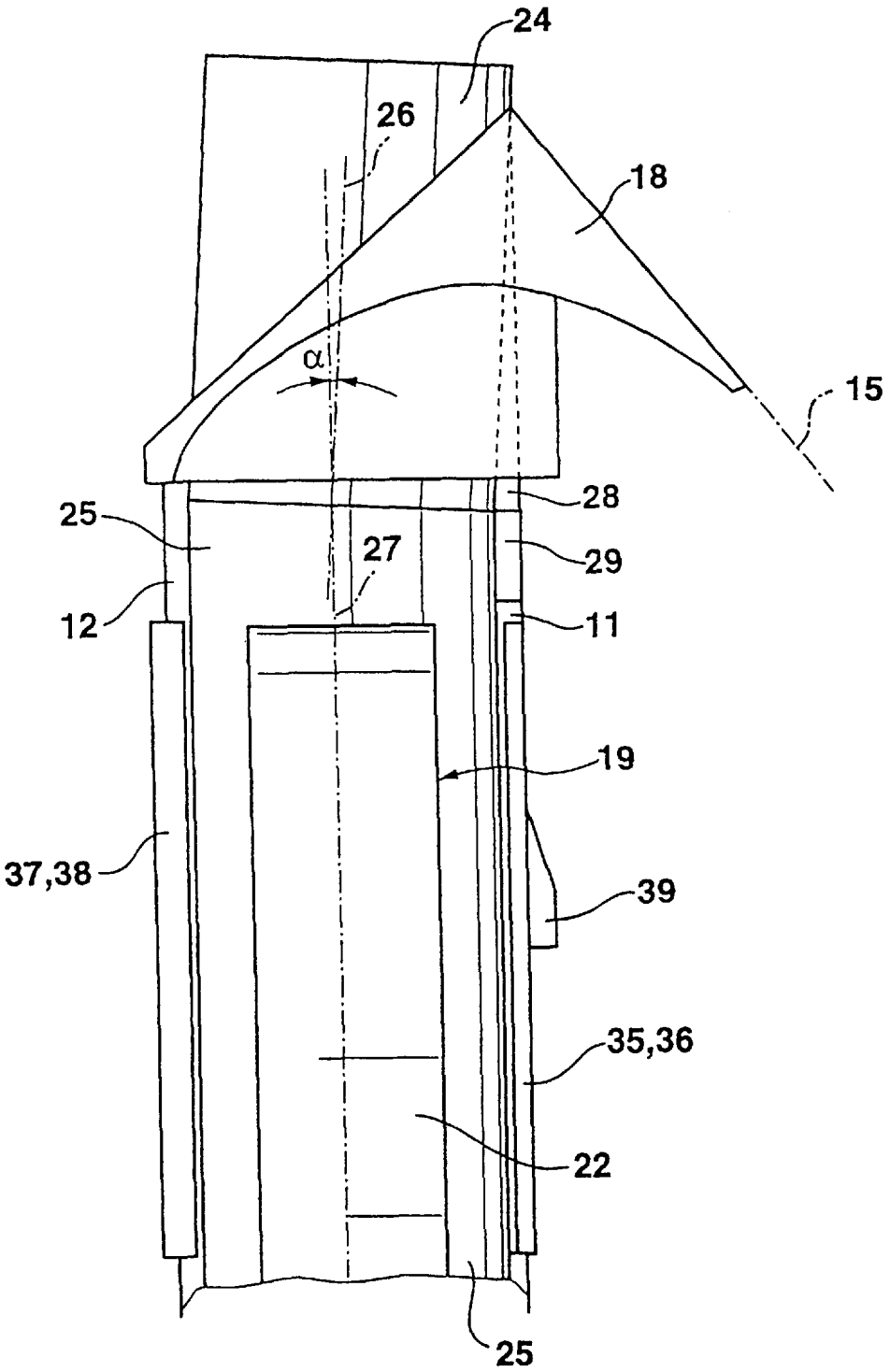
FIG. 3 is a simplified side view of the machine according to FIG. 1.

Each pair of sealing clamps 33, 34 has two heatable sealing clamps 35, 36; 37, 38 which can be horizontally moved against each other. A cutting device 39, which is only depicted in FIG. 3 and is for cutting off a section of the longitudinal seam 11 that protrudes beyond the sealing clamps 35, 36, is disposed on the sealing clamp pair 33 oriented toward the longitudinal seam 11, on the side opposite from the forming tube 19. A longitudinal seam cooling device 40 for each longitudinal seam 11, 12 adjoins each of the sealing clamp pairs 33, 34 flush in the feed direction of the tube 20. A lateral seam sealer 41 is disposed beneath the forming tube 19, which tapers off in a mouthpiece that is not shown. The lateral seam sealer 41 has two lateral seam clamps 42, 43, which can be moved horizontally against each other, with integrated cutting devices for cutting the bag packages 1 from the tube 20.

The above-described bag forming, filling, and sealing machine 10 functions as follows: the sheet of packaging material 15, which is preferably stored in roll form, is continuously or cyclically supplied to the tube forming device 17 by means of the conveyor belts 22, 23. After that, the sheet of packaging material 15 is preformed into the tube 20 by the forming shoulder 18. The one longitudinal seam 12 is formed in a manner that is known per se from the two opposing longitudinal edges of the sheet of packaging material 15. The other longitudinal seam 11 is formed by element 28 formed onto the first section 24 of the forming tube 19. This occurs by virtue of the fact that a section of the tube wall is guided through the slot 30 in the forming shoulder 18 and rests against the side faces of the element 28. This contact is permitted by virtue of the fact that as a result of the first section 24 being inclined by the angle a in relation to the second section 25, the material of the sheet of packaging material 15 required to form the longitudinal seam 11 is supplied in the direction toward the element 28, without this causing tensions within the tube 20. The formation of the longitudinal seam 11 is consequently carried out in a tension-free manner. In the above-explained connection, the result is that the magnitude of the angle $\alpha$ is primarily a function of the width of the longitudinal seam 11 or the height H of the element 28. This means that the higher the element 28 is, and consequently the greater the width of the longitudinal seam 11 is, the greater the angle $\alpha$ has to be selected. The forming of the longitudinal seam 11 is supported by the two guide angles 31, which in particular, also assure that the longitudinal seam 11 is fed to the pair of sealing clamps 33 with tube walls disposed tightly against each other, which facilitates the longitudinal sealing.

After the two longitudinal seams 11, 12 are formed as described above, they arrive in the region of the two sealing clamp pairs 33, 34, which seal the longitudinal seams 11, 12 by means of heat and pressure. In the event that the one longitudinal seam 11 is wider than the sealing clamps 35, 36 of the sealing clamp pair 33, then in the subsequent steps, the protruding, non-sealed region of the longitudinal seal 11 is cut off by means of the cutting device 39. The two sealed longitudinal seams 11, 12 are then cooled by the two longitudinal seam cooling devices 40. As a result, the required seam tightness of the longitudinal seams 11, 12 is achieved for the subsequent filling procedure, which is carried out for example by means of a filling material being supplied through the forming tube 19. Finally, individual bag packages 1 are cut off in a known manner from the tube 20 thus formed by means of the lateral seam sealer 41, which forms the two lateral seams 13, 14 simultaneously.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of: the United States is:

1. A bag forming, filling, and sealing machine (10) for producing bag packages (1) with two sealed lateral seams (13, 14) and two sealed longitudinal seams (11, 12) formed out of a heat-sealable sheet of packaging material (15), comprising a tube forming device (17) for forming a tube (20), a tube feeding device (21) for feeding the tube (20), a lateral seam sealer (41) and two longitudinal seam sealers (33, 34), the tube forming device (17) for forming the tube (20) is comprised of a forming tube (19) and a forming shoulder (18) connected to said forming tube (19) that the forming tube (19) has first and second sections (24, 25), each with a symmetry axis (26, 27), wherein the symmetry axis (26) of the first section (24), which is connected to the forming shoulder (18), is inclined in relation to the symmetry axis (27) of the second section (25) by an angle ($\alpha$), wherein the angle ($\alpha$) points in a direction of the incoming sheet of packaging material (15), that a wedge-shaped element (28) is connected to the first section (24) of the forming tube (19) for the purpose of forming the one longitudinal seam (11) out of a one-piece region of the sheet of packaging material, that the element (28) is disposed inside a slot (30) embodied in the forming shoulder (18), and that the height (H) of the element (28) tapers toward the second section (25) of the forming tube (19).

2. A bag forming, filling, and sealing machine according to claim 1, in which the wedge-shaped element (28) is disposed in an entire overlapping region of the forming shoulder (18) with the forming tube (19).

3. A bag forming, filling, and sealing machine according to claim 1, in which in a region of the second section (25) of the forming tube (19), the element (28) is embodied as elongated by means of a rectangular shoulder element (29).

4. A bag forming, filling, and sealing machine according to claim 2, in which in a region of the second section (25) of the forming tube (19), the element (28) is embodied as elongated by means of a rectangular shoulder element (29).

5. A bag forming, filling, and sealing machine according to claim 3, in which in a region of the shoulder element (29), there are at least one pair of guides (31), which are disposed on opposite sides of the shoulder element (29) and are for one longitudinal seam (11).

6. A bag forming, filling, and sealing machine according to claim 4, in which in a region of the shoulder element (29), there are at least one pair of guides (31), which are disposed on opposite sides of the shoulder element (29) and are for one longitudinal seam (11).

7. A bag forming, filling, and sealing machine according to claim 5, in which the guides (31) are embodied as elongated in the region of the element (28) for producing the one longitudinal seam (11).

8. A bag forming, filling, and sealing machine according to claim 6, in which the guides (31) are embodied as elongated in the region of the element (28) for producing the one longitudinal seam (11).

9. A bag forming, filling, and sealing machine according to claim 1, in which the longitudinal seam sealer (33) for producing the one longitudinal seam (11) is disposed flush with the shoulder element (29) on the second section (25) of the forming tube (19).

10. A bag forming, filling, and sealing machine according to claim 2, in which the longitudinal seam sealer (33) for producing the one longitudinal seam (11) is disposed flush with the shoulder element (29) on the second section (25) of the forming tube (19).

11. A bag forming, filling, and sealing machine according to claim 3, in which the longitudinal seam sealer (33) for producing the one longitudinal seam (11) is disposed flush with the shoulder element (29) on the second section (25) of the forming tube (19).

12. A bag forming, filling, and sealing machine according to claim 5, in which the longitudinal seam sealer (33) for producing the one longitudinal seam (11) is disposed flush with the shoulder element (29) on the second section (25) of the forming tube (19).

13. A bag forming, filling, and sealing machine according to claim 7, in which the longitudinal seam sealer (33) for producing the one longitudinal seam (11) is disposed flush with the shoulder element (29) on the second section (25) of the forming tube (19).

14. A bag forming, filling, and sealing machine according to claim 1, in which the one longitudinal seam sealer (33) is operatively connected to a cutting device (39) for cutting the one longitudinal seam (11) to a particular width.

15. A bag forming, filling, and sealing machine according to claim 2, in which the one longitudinal seam sealer (33) is operatively connected to a cutting device (39) for cutting the one longitudinal seam (11) to a particular width.

16. A bag forming, filling, and sealing machine according to claim 3, in which the one longitudinal seam sealer (33) is operatively connected to a cutting device (39) for cutting the one longitudinal seam (11) to a particular width.

17. A bag forming, filling, and sealing machine according to claim 5, in which the one longitudinal seam sealer (33) is operatively connected to a cutting device (39) for cutting the one longitudinal seam (11) to a particular width.

18. A bag forming, filling, and sealing machine according to claim 7, in which the one longitudinal seam sealer (33) is operatively connected to a cutting device (39) for cutting the one longitudinal seam (11) to a particular width.

19. A bag forming, filling, and sealing machine according to claim 9, in which the one longitudinal seam sealer (33) is operatively connected to a cutting device (39) for cutting the one longitudinal seam (11) to a particular width.

* * * * *